US011339035B2

(12) United States Patent
Rantala

(10) Patent No.: US 11,339,035 B2
(45) Date of Patent: May 24, 2022

(54) CONTROLLING OF LIFTING DEVICE

(71) Applicant: Konecranes Global Oy, Hyvinkää (FI)

(72) Inventor: Kimmo Rantala, Hyvinkää (FI)

(73) Assignee: Konecranes Global Oy, Hyvinkää (FI)

( * ) Notice: Subject to any disclaimer, the term of this patent is extended or adjusted under 35 U.S.C. 154(b) by 299 days.

(21) Appl. No.: 15/753,659

(22) PCT Filed: Aug. 19, 2016

(86) PCT No.: PCT/FI2016/050569

§ 371 (c)(1),
(2) Date: Feb. 20, 2018

(87) PCT Pub. No.: WO2017/032921

PCT Pub. Date: Mar. 2, 2017

(65) Prior Publication Data

US 2018/0237274 A1 Aug. 23, 2018

(30) Foreign Application Priority Data

Aug. 21, 2015 (FI) ..... 20155598

(51) Int. Cl.
*B66C 13/40* (2006.01)
*B66C 17/00* (2006.01)

(52) U.S. Cl.
CPC ..... *B66C 13/40* (2013.01); *B66C 17/00* (2013.01)

(58) Field of Classification Search
CPC ..... B66C 13/40; B66C 17/00
See application file for complete search history.

(56) References Cited

U.S. PATENT DOCUMENTS

| | | | | |
|---|---|---|---|---|
| 5,043,646 | A | 8/1991 | Smith, III et al. | |
| 2003/0164349 | A1 | 9/2003 | Kohlenberg | |
| 2010/0145526 | A1 | 6/2010 | Yamaguchi et al. | |
| 2011/0066335 | A1* | 3/2011 | Hashimoto | B66C 13/40 701/50 |
| 2013/0105430 | A1* | 5/2013 | Ogawa | B66C 13/40 212/282 |
| 2014/0184643 | A1* | 7/2014 | Friend | G09G 3/003 345/633 |

(Continued)

FOREIGN PATENT DOCUMENTS

| | | | |
|---|---|---|---|
| CN | 101985344 | A | 3/2011 |
| CN | 103781718 | A | 5/2014 |

(Continued)

OTHER PUBLICATIONS

Search Report received for Chinese Patent Application No. CN2016800485283, dated Nov. 20, 2018, 2 pages including partial English translation.

(Continued)

*Primary Examiner* — Sang K Kim
*Assistant Examiner* — Nathaniel L Adams
(74) *Attorney, Agent, or Firm* — Ziegler IP Law Group, LLC

(57) ABSTRACT

A method and equipment for controlling a lifting device, wherein a main steering direction of the control device used by an operator is selected from at least two options; the impact of the control device on the directions of motion of the lifting device is changed according to the selected main steering direction; and the lifting device is controlled with a control device.

15 Claims, 3 Drawing Sheets

(56) References Cited

U.S. PATENT DOCUMENTS

| | | | | |
|---|---|---|---|---|
| 2014/0251935 | A1 | 9/2014 | Behnke | |
| 2018/0024546 | A1* | 1/2018 | Ha | B64C 39/024 701/2 |
| 2018/0252921 | A1* | 9/2018 | Rantala | G06F 3/012 |
| 2018/0341245 | A1* | 11/2018 | Vinati | B66C 13/40 |

FOREIGN PATENT DOCUMENTS

| | | | |
|---|---|---|---|
| DE | 4217989 | A1 | 12/1993 |
| DE | 102004060484 | A1 | 6/2006 |
| DE | 102012021422 | A1 | 4/2014 |
| DE | 102013006258 | A1 | 10/2014 |
| EP | 2450304 | A1 | 5/2012 |
| FI | 96502 | C | 7/1996 |

OTHER PUBLICATIONS

Finnish Patent Office, Search Report, Application No. 20155598, dated Apr. 28, 2016, 2 pages.

International Search Report and Written Opinion of the International Searching Authority, Application No. PCT/FI2016/050569, dated Nov. 9, 2016, 5 pages.

International Preliminary Report on Patentability, Application No. PCT/FI2016/050569, dated Dec. 20, 2017, 17 pages.

* cited by examiner

CONTROLLING OF LIFTING DEVICE

TECHNICAL FIELD

The aspects of the disclosed embodiments generally relate to controlling a lifting device. The present disclosure relates particularly, though not exclusively, to controlling an industrial crane from the floor level with a wireless control device.

BACKGROUND ART

An industry crane typically moves along rails mounted close to the ceiling in the longitudinal direction. A trolley moving laterally along the main girder enables a lateral movement. The lifting device has a loading member for grabbing a load e.g. via a hook, a rope, a wire, or a lifting sling. The loading member can be lifted and lowered. Hence, the loading member can be controlled in XYZ directions within the operational range of the crane.

Industrial cranes are commonly controlled from the floor level. An operator of the crane positions himself so that he can readily see the load and its surroundings. Especially through radio control, the operator of the crane can position himself in a safe place with a good line of sight of the loading member or the load. A control device with a wire, i.e. a pendant control station, is a good option in some locations i.a. because it does not require a local current source.

The control device of a lifting device commonly contains, corresponding to four different directions of motion, four switches that correspond to two different longitudinal directions of motion and two different lateral directions of motion and separate switches for lifting and lowering the lifting device. The different directions of motion are marked with symbols which are also marked on the crane. Thus the operator can by first looking at the crane select the symbol of the desired direction of motion and then use the correspondingly marked switch of the control device.

The operator does not always verify the steering directions from the symbols, in which case the operator has to perceive his own position (angle) in relation to the directions of the crane and conclude the steering direction suitable for the situation. The concluding might easily result in selecting the wrong steering direction. On lifting heavy or big loads, a wrong choice might result in dangerous situations. The concluding can be facilitated by giving a short control tap in an arbitrary direction and noting the motion of the crane. This test is an extra movement and it may cause unnecessary swinging of the load.

The present disclosure aims to avoid the aforementioned problems or at least to offer a new technical alternative.

SUMMARY

According to a first aspect of the disclosed embodiments there is provided a method for controlling a lifting device, the method comprising:

- selecting a main steering direction of the control device used by an operator from at least two options;
- changing the impact of the control device on the directions of motion of the lifting device according to the selected main steering direction; and
- controlling the lifting device with the control device.

The lifting device may be selected from a group constituted of the following options: industrial crane; bridge crane; jib; gantry crane; and semi-gantry crane. The crane may be controlled, e.g. in the case of a bridge crane, from the floor level.

The control device may be a hand control: The control device may be in connection with the control system of a lifting device with wires or wirelessly.

By changing the impact of the control device an intuitive change in the function of the control device may be achieved to correspond to the predominant front direction of the operator. In this way learning how to operate the lifting device is made easier and the risk of false steps is reduced.

The main steering direction may be selected by a command given by the operator. The command given by the operator may be detected from the use of a switch changing the main steering direction. Detecting the command given by the operator may require passing a determined time threshold.

The selected main steering direction may be presented to the operator. The selected main steering direction may be presented with the control device. The selected main steering direction may be presented with a pointer placed outside the lifting device. The pointer may comprise a mark attached to a wall or a structure. The mark may be formed using at least one light, color coding, pattern or a clearly distinguishable piece. The selected main steering direction may be displayed from the control device by projection to its surroundings as a pattern. The selected main steering direction may be displayed from the control device by projection to its surroundings as a pattern. The pattern may be projected onto a floor or a wall. The selected main steering direction may be presented with smart glasses.

The main steering direction may be selected automatically. The main steering direction may be selected automatically by using the orientation detection of the control device. The automatic orientation detection of the control device may function by using any of the following: a gyroscope, magnetometer, or optical detection. The smart glasses may contain an image sensor, through which the main steering direction may be detected based on the operator's field of view. The automatic selection of the main steering direction may only be implemented if the crane is stationary. The automatic selection of the main steering direction may be subjected to the operator's approval.

The main steering direction may be selected from two opposite main steering directions. With two opposite main steering directions the user interface elements of the longitudinal and lateral control may be retained in their positions.

The control device may comprise a control unit that receives the operator's input. Optionally, the control device may comprise two separate control units receiving the operator's input. Different control units may be associated with different main steering directions. Using different control units may prevent accidentally moving the lifting device in the wrong direction e.g. when automatically selecting the main steering direction.

Optionally, a main steering direction may be selected from four main steering directions.

Two or more lifting devices may be simultaneously controlled with the control device according to the main steering direction.

According to a second aspect of the disclosed embodiments there is provided a control system of a lifting device comprising: a control device; means for selecting a main steering direction of the control device used by an operator from at least two options; means for changing the impact of the control device on the directions of motion of the lifting device according to the main steering direction; and means for controlling the lifting device with the control device.

The control system may consist of the control device. Optionally, the control system may comprise other parts, such as a controller of the lifting device. The controller may be equipment managing the movements and/or monitoring the condition of the lifting device.

The control system may comprise means for implementing any of the preceding methods.

According to a third aspect of the disclosed embodiments there is provided a lifting device system comprising a lifting device and a control system of said lifting device.

The lifting device system may comprise two lifting devices. The control system of the lifting device may be available for the simultaneous control according to the selected steering direction of lifting devices comprised by the lifting device system.

According to a fourth aspect of the disclosed embodiments there is provided a computer program comprising program code executable by a computer adapted to execute the method according to the first aspect of the invention. The computer may be a programmable logic circuit.

The computer program may be stored in a memory.

According to a fifth aspect of the disclosed embodiments there is provided a updating unit of a lifting device comprising a control system according to the second aspect of the invention or a computer program according to the fourth aspect of the invention adapted to control a lifting device in accordance with the state of the art.

The different embodiments of the present disclosure are described or have been described only in one or in some of the aspects of the present disclosure. A person skilled in the art understands that any embodiment of any aspect of the present disclosure may be applied in any embodiment of the same or a different aspect of the present disclosure, alone or together with other embodiments of the present disclosure.

BRIEF DESCRIPTION OF THE DRAWINGS

Some embodiments of the present disclosure will be described with reference to the accompanying drawings, in which.

DETAILED DESCRIPTION

In the following description, like reference signs denote like elements or steps. It should be noted that the figures presented are not to scale in their entirety, and that they mainly serve only an illustrative purpose.

Figure 1:
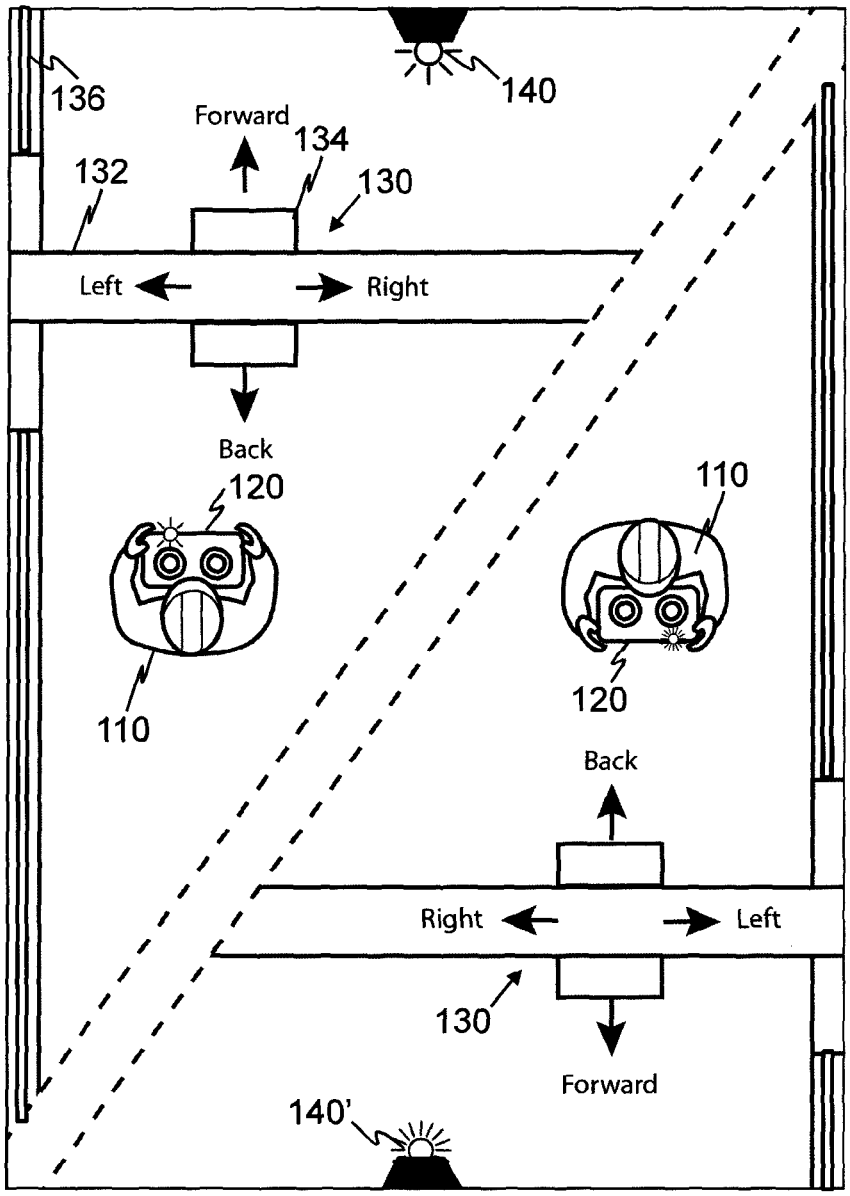
FIG. 1 shows a simplified figure of a use case of a lifting device according to an embodiment of the invention in two different usage situations.

FIG. 1 shows a simplified figure of a use case 100 according to an embodiment of the present disclosure. FIG. 1 shows a first usage situation wherein, seen from the above, an operator 110 is positioned in a first direction, such as facing one end of a factory hall. The operator holds in his hands a control device 120 and the lifting device 130 in front of the operator so that the operator can readily supervise the operation of the lifting device. The directions of motion of the lifting device are marked around the trolley of the lifting device by the marks Forward, Back, Left and Right. The control device includes a control unit, such as a joystick, moving which in directions corresponding to the directions of motion, the operator can steer the lifting device in a desired direction.

The mark 140 of the first main steering direction, such as a directional signal indicated with a certain pattern, color and/or light, is in the front direction, i.e. approximately in the gaze direction, of the operator. The control device has a corresponding direction indicator 240 (FIG. 2), such as a symbolic or written indication and/or an indicator light presented on a screen.

Figure 2:
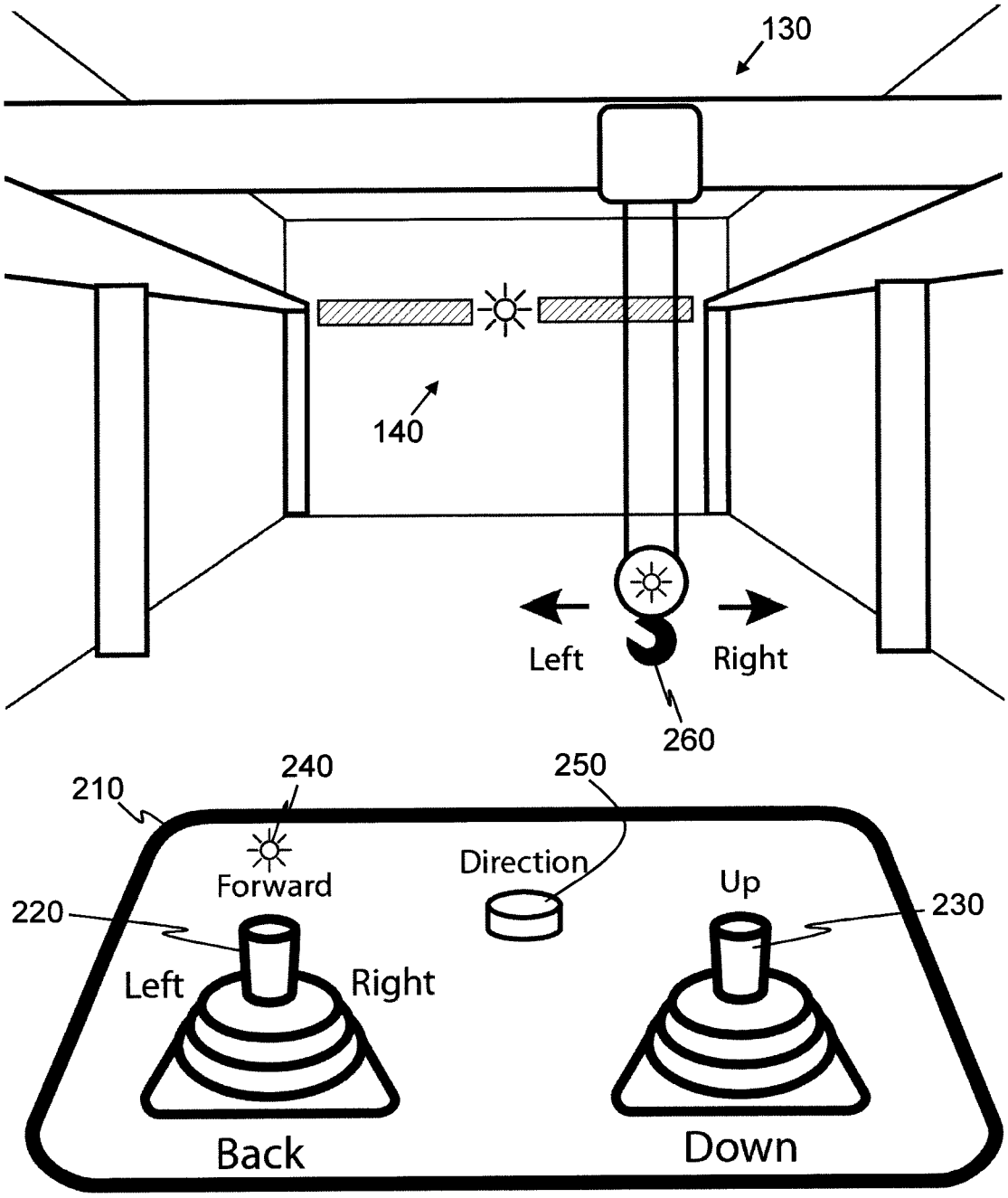
FIG. 2 shows details from the first use situation of FIG. 1 and a user interface of a control device of an embodiment of the present disclosure.

FIG. 1 also presents a second usage situation, wherein the operator 110 is positioned in a second direction, such as facing one end of a factory hall. The operator holds in his hands a control device 120 and the lifting device 130 in front of the operator so that the operator can readily supervise the operation of the lifting device. This time, in the operator's front direction, there is a second mark 140' of a main steering direction, which is a mark formed to be distinguishable from the mark 140 of the first main steering direction, implemented with e.g. a certain pattern, color and/or light. FIG. 2 shows a two-piece mark of a main steering direction comprising a pattern and a portion filled with a certain color or pattern. In FIG. 1 the differences between directions have been illustrated with different rays from the mark or indicator light.

The lifting device may be a bridge crane including a main girder 132 and a trolley 134. The main girder 132 is adapted to run along rails 136, in FIG. 1 in the vertical direction.

When controlling from the floor level, it is common that the operator's front direction may turn in relation to the lift and the load.

FIG. 2 shows details of the first use situation of FIG. 1 and a user interface 210 of a control device 120 according to an embodiment of the present disclosure. The user interface 210 includes a first joystick 220 to control the lifting device in the horizontal plane, i.e. in the X and Y directions, e.g. running the main girder of the lifting device along rails and the trolley along the main girder, together with a second joystick 230 to control the lifting device in the vertical direction, i.e. in the Z direction. The user interface also includes a direction indicator 240 and a switch 250 changing the main steering direction. FIG. 2 also shows lifting means used by the lifting device, such as a lifting hook 260 attached to a rope pulley. Marks indicating the main steering directions are formed on the rope pulley or on the housing of the rope pulley so that the operator can also from these see the main steering direction that is in his front direction.

Figure 3:
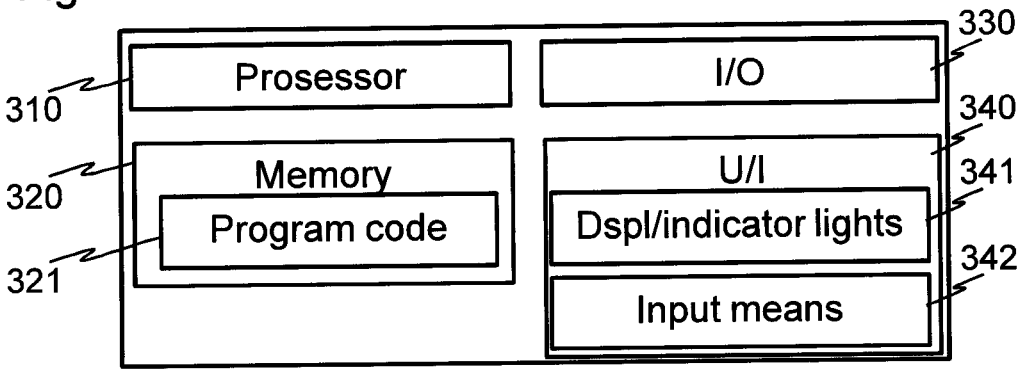
FIG. 3 shows a block diagram of a control device according to an embodiment of the present disclosure.

FIG. 3 shows a block diagram of a control device according to an embodiment of the present disclosure. The control device 120 comprises a processor 310; a memory 320; and program code 321 stored in the memory, to control the operation of the control device 120 when executed by the processor 310.

Figure 6:
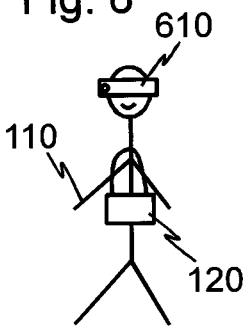
FIG. 6 shows with simplification main parts of a control device.

The control device further comprises a data transfer unit I/O 330 to transfer data with the control device and a lifting device or control means of a lifting device and to transfer data between the control device and smart glasses 610 shown in FIG. 6, a user interface 340 comprising presenting means 341, such as a screen and/or indicator lights (e.g. to implement the direction indicator 240), and input means.

The input means may comprise e.g. one or more buttons, touch detection on a screen or on other parts, or keys or a keyboard. In the embodiment shown in FIG. 6 the control device comprises, as an add on used optionally, means of augmented reality, such as smart glasses 610 including a screen and possibly also a camera. The smart glasses may be e.g. Sony SmartEyeglass™, Epson Moverio BT-200™; Google Glass™, Vuzix M100 Smart Glasses™, or GlassUp™. The smart glasses can complement or replace the user interface 340 partly or completely.

Figure 4:
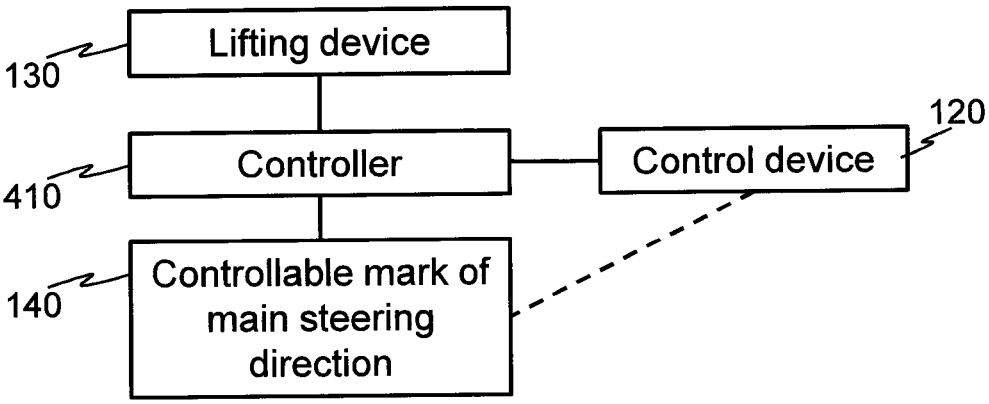
FIG. 4 shows a block diagram of a system according to an embodiment of the present disclosure.

FIG. 4 shows a block diagram of a system 400 of an embodiment of the present disclosure. The system 400 comprises a control device 120, a lifting device 130, a controllable mark 140 of the main steering direction and a controller 410 that controls the lifting device. The controller 410 may also control the controllable mark 140 of the main steering direction. Optionally, the mark 140 of the main steering direction is controlled by the control device 120 itself, possibly through one or more link devices. This option can be useful e.g. if changing the main steering directions is implemented in a control device independent of the controller 410.

Figure 5:
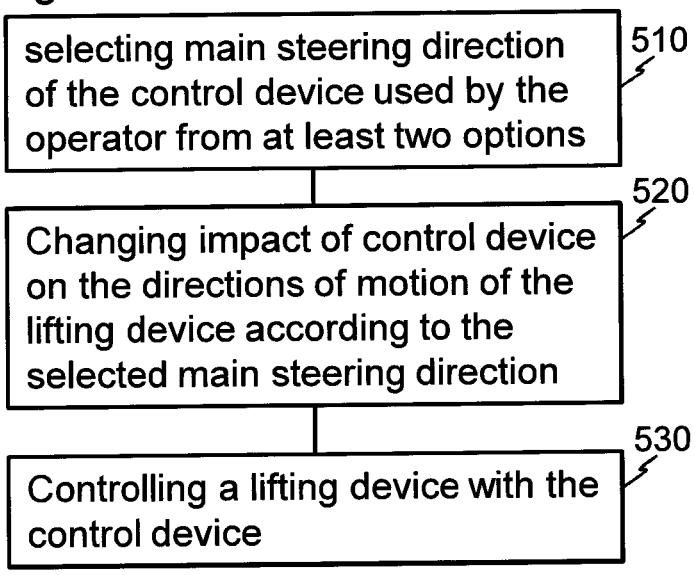
FIG. 5 shows a flowchart of a method according to an embodiment of the present disclosure.

FIG. 5 shows a flowchart of a method for controlling the lifting device according to an embodiment of the present disclosure comprising: selecting 510 the main steering direction of the control device used by the operator from at least two options; changing 520 the impact of the control device on the directions of motion of the lifting device according to the selected main steering direction; and controlling 530 a lifting device with the control device.

The main steering direction can be selected based on a command given by the operator. The command given by the operator can be detected from the use of a switch changing the main steering direction. Detecting the command given by the operator may require passing a determined time threshold. E.g. changing the main steering direction may require that the operator holds down the switch 250 changing the main steering direction for at least the duration of the time threshold. In an embodiment of the present disclosure, a progressive status indicator showing how the time threshold is elapsing is presented to the operator.

The selected main steering direction can be presented to the operator e.g. with the direction indicator 240. The selected main steering direction can be presented with the control device. The selected main steering direction can be presented with an indicator placed outside the lifting device. The indicator may comprise a mark attached to a wall or a structure, such as the mark of the main steering direction 140, 140'. The mark may be formed using at least one light, color coding, a pattern or a clearly distinguishable piece. The selected main steering direction can be displayed from the control device by projection to its surroundings as a pattern. The pattern can be projected onto a floor, a wall or dust in the room air. The selected main steering direction can be presented with smart glasses.

The main steering direction may be selected automatically. The main steering direction can be selected automatically by using the orientation detection of the control device. The automatic orientation detection of the control device can function by using any of the following: a gyroscope, magnetometer, optical detection. The smart glasses can contain an image sensor, through which the main steering direction can be detected based on the field of view of the operator. The automatic selection of the main steering direction can only be implemented if the crane is stationary. The automatic selection of the main steering direction can be subjected to the operator's approval. On using the automatic selection of a main steering direction, a separate approval can be prompted from the operator after the main steering direction has been changed. The approval can be prompted also, if it is automatically detected from a change in the operator's front direction or in the orientation of the control device, that the main steering direction should be changed or the front direction or the orientation of the control device is at a transitional interval between two different main steering directions. The transitional interval can be e.g. a 10, 15 or 30 degree wide sector.

The main steering direction can be selected from two opposite main steering directions. Using two opposite main steering directions the user interface elements of the longitudinal and lateral control can be retained in their positions.

The control device may comprise one control unit receiving input from the operator. Optionally, the control device may comprise two different control units receiving input from the operator. Different control units can be associated with different main steering directions. Using different control units can prevent accidentally moving the lifting device in the wrong direction e.g. when automatically selecting the main steering direction.

Optionally, the main steering direction can be selected from four different main steering directions.

In the light of the aforementioned descriptions several advantageous technical effects appear. E.g. selecting the main steering direction yields the advantage, that when the operator is viewing a lift in his own front direction, the operator can always drive clearly away from himself (or towards himself). When big or extended pieces are lifted, a joint two hook lift is often used in the attachment, e.g. lifting a common loading member or with two hoists (tandem). The implementation of the two hoists can be done with one lifting device (e.g. two hoists in one bridge crane) or with a joint use of two lifting devices, e.g. a joint lift with two bridge cranes. The loading member can contain a rigid bar supporting two hooks, especially when the distance between the hooks is constant. This may occur e.g. in paper or steel industry when large, finished rolls and coils are lifted. In the maintenance, lifting rolls and rollers may be necessary when changing them. The same problem is encountered in the assembly of large bodies, e.g. lifting the wing of an airplane or turning it into a new orientation. The problem of the operator is the visual barrier created between the hooks by the large load, i.e. the attachment points of both hooks cannot be seen from one standpoint. To assure himself of the attachments, the operator should move to different sides of the load, which may change the front direction. For this problem, i.e. to demonstrate the reliable attachment of several attachments, mechanical indication devices or signaling means exists, but these do not always work and them being out of order do not prevent driving the crane.

The foregoing description provides non-limiting examples of particular implementations and embodiments of the present disclosure. It is however clear to a person skilled in the art that the present disclosure is not restricted to details of the embodiments presented in the foregoing, but that it can be implemented in other equivalent ways.

Some of the features of the afore-disclosed embodiments may be used to advantage without the corresponding use of other features. As such, the foregoing description shall be considered as merely illustrative of the principles of the present disclosure and not as limiting the invention. The scope of the present disclosure is only restricted by the appended patent claims.

The invention claimed is:

1. A method for controlling a lifting device, comprising:

selecting a main steering direction of a control device used by an operator from only one of a first main steering direction and a second main steering direction, the second main steering direction being opposite to the first main steering direction, the first main steering direction and the second main steering direction being a longitudinal direction of movement of the lifting device;

changing an impact of the control device on directions of motion of the lifting device to correspond to the selected main steering direction; and controlling the lifting device with the control device.

2. The method according to claim 1, wherein the lifting device is selected from a group consisting of the following: an industrial crane; a bridge crane; a jib; a gantry crane; and a semi-gantry crane.

3. The method according to claim 1, comprising presenting the selected main steering direction to the operator.

4. The method according to claim 3, comprising presenting the selected main steering direction with the control device.

5. The method according to claim 1, comprising selecting the main steering direction based on a command given by the operator.

6. The method according to claim 5, comprising detecting the command given by the operator from the use of a switch changing the main steering direction.

7. The method according to claim 1, comprising automatically selecting the main steering direction.

8. The method according to claim 7, comprising allowing to change the main steering direction only if the crane is stationary.

9. The method according to claim 1, comprising simultaneously controlling two or more lifting devices with the control device according to the selected main steering direction.

10. The method according to claim 1, further comprising, after selecting the main steering direction generating a mark visible to the operator in a direction of the selected main steering direction and generating a direction indicator on the control device that corresponds to the direction of the main steering direction.

11. A control system of a lifting device comprising:

a control device;

means for selecting a main steering direction of the control device used by an operator from only one of a first main steering direction and a second main steering direction, the second main steering direction being opposite to the first main steering direction, the first main steering direction and the second main steering direction being a longitudinal direction of movement of the lifting device;

means for changing an impact of the control device on directions of motions of the lifting device to correspond to the selected main steering direction; and means for controlling the lifting device with the control device.

12. The control system of the lifting device according to claim 11, wherein the control system of the lifting device comprises means for achieving the method according to claim 2.

13. A lifting device system comprising:

a lifting device;

the lifting device system comprises the control system of the lifting device according to claim 11.

14. The lifting device system according to claim 13, wherein the lifting device system comprises two lifting devices wherein, in the lifting device system, the control system is adapted to be capable of simultaneously controlling said lifting devices according to the selected steering direction.

15. A non-transitory computer program product, wherein the non-transitory computer program product comprises program code, which when executed by a computer, causes the computer to:

select a main steering direction of a control device used by an operator from only one of a first main steering direction and a second main steering direction, the second main steering direction being opposite to the first main steering direction, the first main steering direction and the second main steering direction being a longitudinal direction of movement of a lifting device;

change an impact of the control device on directions of motion of the lifting device to correspond to the selected main steering direction; and control the lifting device with the control device.

* * * * *